US009689564B2

(12) United States Patent
Yu et al.

(10) Patent No.: US 9,689,564 B2
(45) Date of Patent: Jun. 27, 2017

(54) SYSTEM TO ALLOCATE LUMINANCE

(71) Applicants: Scott S Yu, Mil Valley, CA (US); Tom Warton, Sonoma, CA (US)

(72) Inventors: Scott S Yu, Mil Valley, CA (US); Tom Warton, Sonoma, CA (US)

(73) Assignee: Vode Lighting, LLC, Sonoma, CA (US)

( * ) Notice: Subject to any disclaimer, the term of this patent is extended or adjusted under 35 U.S.C. 154(b) by 304 days.

(21) Appl. No.: 14/214,764

(22) Filed: Mar. 15, 2014

(65) Prior Publication Data

US 2014/0268726 A1 Sep. 18, 2014

Related U.S. Application Data

(60) Provisional application No. 61/794,591, filed on Mar. 15, 2013.

(51) Int. Cl.

| | |
|---|---|
| ***F21V 21/26*** | (2006.01) |
| *F21S 8/08* | (2006.01) |
| *F21Y 113/00* | (2016.01) |
| *F21Y 115/10* | (2016.01) |

(52) U.S. Cl.

CPC ..... *F21V 21/26* (2013.01); *F21S 8/08* (2013.01); *F21Y 2113/00* (2013.01); *F21Y 2115/10* (2016.08)

(58) Field of Classification Search

CPC ..... F21V 21/26; F21V 21/06; F21V 21/14; F21V 17/107; F21S 6/002; F21S 6/003; F21S 6/005; F16M 11/10

USPC ..... 248/121, 123.11, 123.2, 125.8, 125.9, 248/148, 149, 150, 590; 403/91–103, 403/119, 120, 145, 146, 161–163; 362/274, 282, 427

See application file for complete search history.

(56) References Cited

U.S. PATENT DOCUMENTS

| | | | | | |
|---|---|---|---|---|---|
| 2,395,178 | A * | 2/1946 | Fiori | F21V 21/26 | 174/542 |
| 3,374,347 | A * | 3/1968 | Hirose | F21V 21/26 | 248/276.1 |
| 3,593,952 | A * | 7/1971 | Smith | A61N 5/01 | 248/214 |
| 4,545,555 | A * | 10/1985 | Koch | F16M 11/04 | 248/280.11 |
| 5,092,552 | A * | 3/1992 | Dayton | F16C 11/0661 | 248/181.1 |
| 5,231,734 | A * | 8/1993 | Rude | E05D 11/084 | 16/322 |
| 5,422,802 | A * | 6/1995 | Lin | F16M 11/06 | 362/269 |
| 5,566,048 | A * | 10/1996 | Esterberg | G06F 1/1616 | 16/307 |

(Continued)

*Primary Examiner* — Joshua Kennedy

(74) *Attorney, Agent, or Firm* — Antero & Tormey, PC; Peter Tormey

(57) ABSTRACT

A device comprising an arm, with a hollow portion, a hub having a stator portion, and an elongated portion disposed into the arm; a rotor with an elongated portion for housing part of a spring. Wherein the spring has a first end disposed in the arm and a second end disposed in the elongated portion of the rotor, and a moveable arm, with a substantially hollow portion operable to receive the elongated portion of the rotor. Certain embodiments may include more than one moveable arm.

5 Claims, 4 Drawing Sheets

(56) References Cited

U.S. PATENT DOCUMENTS

| | | | | |
|---|---|---|---|---|
| 6,367,756 | B1 * | 4/2002 | Wang | F16M 11/04 248/276.1 |
| 8,523,131 | B2 * | 9/2013 | Derry | F16M 11/04 16/338 |
| 8,801,320 | B2 * | 8/2014 | Ng | F16M 11/2021 16/289 |
| 2003/0172497 | A1 * | 9/2003 | Cha | E05D 11/082 16/342 |
| 2015/0097092 | A1 * | 4/2015 | Fu | F16M 11/10 248/123.11 |

* cited by examiner

SYSTEM TO ALLOCATE LUMINANCE

PRIORITY

This application claims the benefit of co-pending provisional patent application 61/794,591 filed Mar. 15, 2013 entitled "System To Allocate Luminance" by the same inventors which is incorporated by reference as if fully set forth herein.

BACKGROUND

The present invention relates generally to a luminaire and with more particularly to a modular lighting system, which comprises a plurality of lighting system components, which can be designed in a variety of different ways. With even more particularity to a device for attaching a lighting system to a support structure and for adjusting a luminaire position. Lighting fixtures are one of the basic lighting devices used in homes, offices and a variety of industrial settings. A typical lighting fixture may be mounted on a wall, at a position above a desk, in a corridor, a door entrance, or a garage door such that the lighting fixture can illuminate the area. There are many factors that control the market for luminaires and lighting systems. A few important factors are the ability to create a well-lit hospitable environment, cost efficiency such as operating cost and other associated costs, code compliance, and more particularly aesthetics. One task lighting designers have is finding adjustable illumination in accordance with an architectural design. Traditional luminaires when mounted expose a bulky base to support the luminaire. This creates an aesthetics issue. To make the environment more aesthetically pleasing, the base of the luminaire should be clean and sleek. Additionally lighting designers have the task of positioning luminaires at the correct angle to better illuminate the environment. As such there is a need for an easy to install, affordable means for attaching a lighting system to a wall or other support structure such that no escutcheon or canopy is required, and for adjusting the positioning of the luminaire.

SUMMARY

Disclosed herein is a device comprising an arm, said arm having a hollow portion, a hub, said hub having a stator portion, said hub having an elongated portion disposed into the arm; a rotor, said rotor including an elongated portion for housing part of a spring, said spring having a first end disposed in the arm and a second end disposed in the elongated portion of the rotor, and a moveable arm, said movable arm including a substantially hollow portion operable to receive the elongated portion of the rotor. Certain embodiments may include more than one moveable arm.

DESCRIPTION

Figure 1:
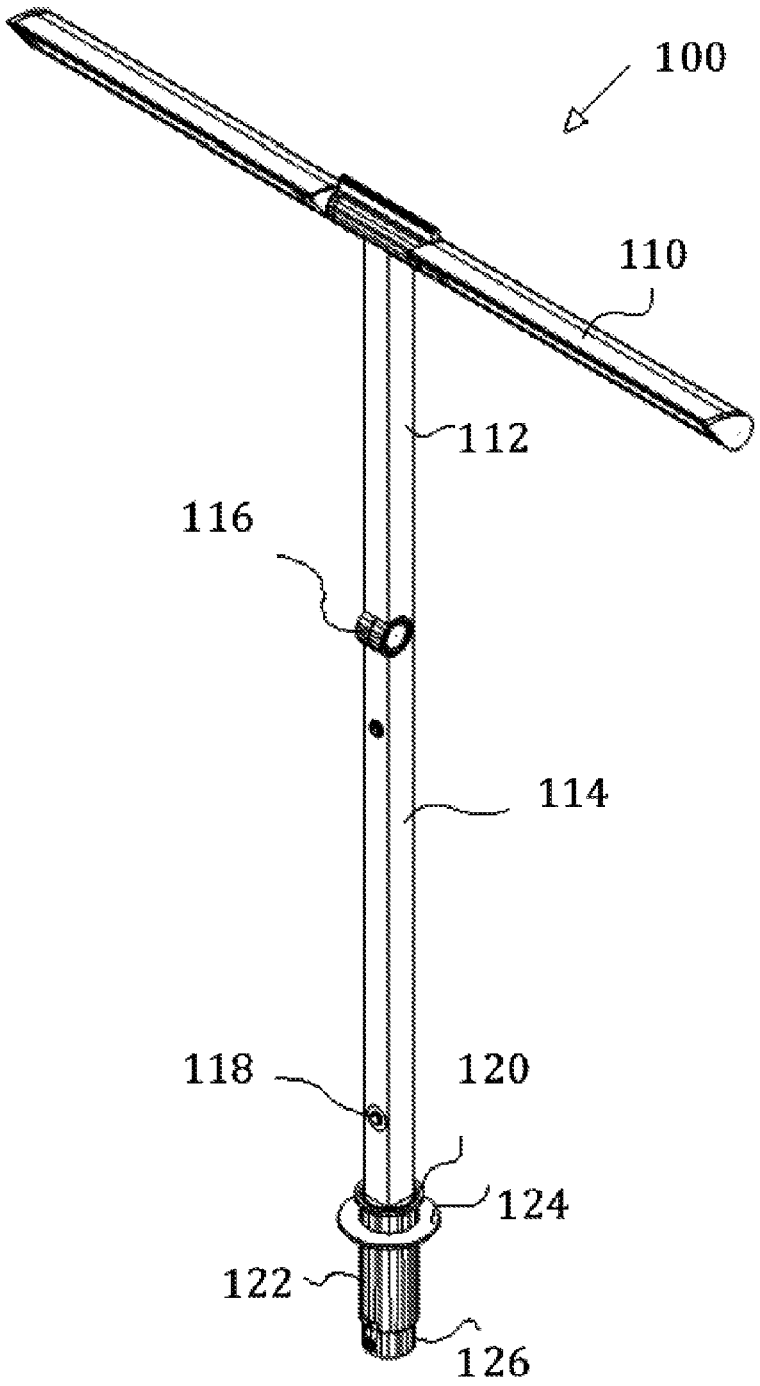
FIG. 1 illustrates a luminaire 110 mounted in a lighting fixture.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Read this application with the following terms and phrases in their most general form. The general meaning of each of these terms or phrases is illustrative, not in any way limiting.

Lexicography

The term "luminaire" generally refers to a lighting unit consisting of a lamp or lamps together with the parts designed to distribute the light, to position and protect the lamps and to connect the lamps to the power supply.

The term "luminance" generally refers to the brightness of a light source or an object that has been illuminated by a source.

DETAILED DESCRIPTION

FIG. 1 illustrates a luminaire 110 mounted in a lighting fixture 100. The lighting fixture 100 has a first arm 112 and a second arm 114. The first and second arm 112 and 114 are coupled via a knuckle 116. The knuckle is spring loaded (not shown) for tensioning the lighting fixture 100 when the first arm is pivoted. A power switch 118 is disposed into the second arm 114 for controlling the luminaire 110. The second arm 114 swivels about a base plate 120, which in operation would be disposed above the mounting surface (not shown). The base plate 120 is coupled atop a base 122. The base 122 may be partially threaded to allow for coupling to a hex nut, clip or other threaded fastener (not shown). The hex nut may be used to hold in place a separator 124 such as a washer and the like. Together the hex nut and separator 124 form a part of a means for fastening the base 122 to a surface. A portion of the base has boreholes (not shown) for receiving screws and the like. When the second arm 114 is positioned into an opening in the base plate 120 and into the base 122, the screws are used to secure the second arm 114 in place. A covering 126, with compartment (not shown), is affixed to the bottom of the fixture support opposite side of the base plate 120.

In operation, electrical power is supplied through an opening in the covering 126 into the base 122 into the second arm 114, through the knuckle 116, into the first arm 112 and to the luminaire 110. The electrical power is wired through the power switch 118 before being coupled to the luminaire 110. A user controls the luminaire 110 by operating the power switch 118. One having skill in the art will appreciate that other control devices such as occupancy sensors may be employed in lieu of, or along with, the power switch 118, thus effectuating control of the luminaire using more advanced means. The user can adjust the position of the luminaire 110 by pivoting the first arm 112 at the knuckle 116. In addition, power for other devices besides the luminaire may be routed through the fixture support.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
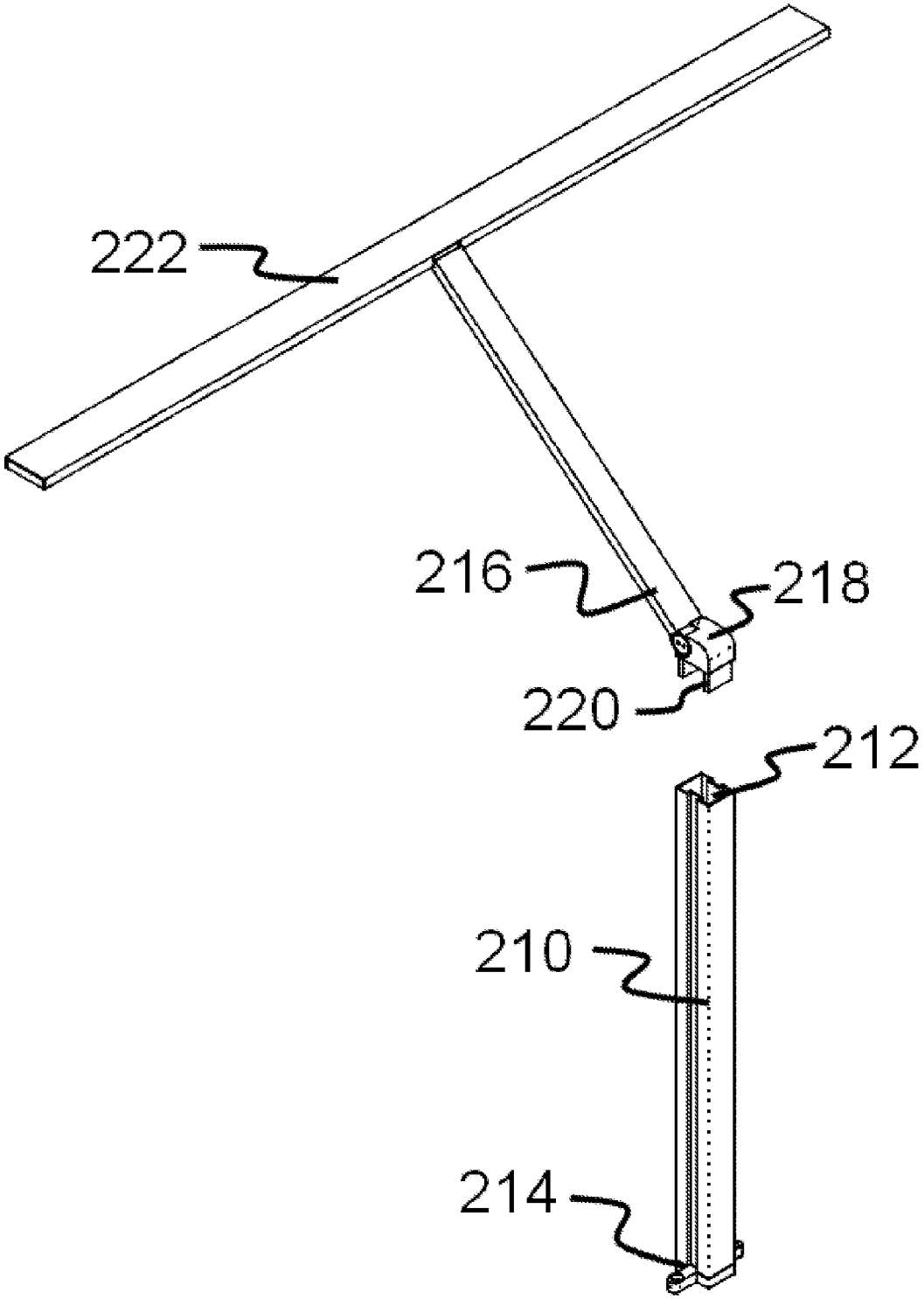
FIG. 2 shows an alternative embodiment according to the present disclosure.

FIG. 2 shows an alternative embodiment according to the present disclosure. In FIG. 2 an arm 210 includes a hollow center area 212 and an end cap 214 which includes support for mounting the arm 210. A movable arm 216 includes a spring-loaded pivot hub 218. The pivot hub 218 includes two tabs 220 formed to fit snugly into the hollow center 212 of the arm 210. Spring tension may be set to accommodate the weight of the movable arm 216 and a light rail 222 attached at the end of the movable arm 216.

The light rail 22 may include controls for operating a light source such as one or more light emitting diodes (LEDs) or lamps. These controls may include switches, or in some embodiments an operating switch may be placed on either the movable arm 216 or the arm 210. In operation the tabs 220 are inserted into the hollow 212 and the light rail 222 is held upright.

Figure 3:
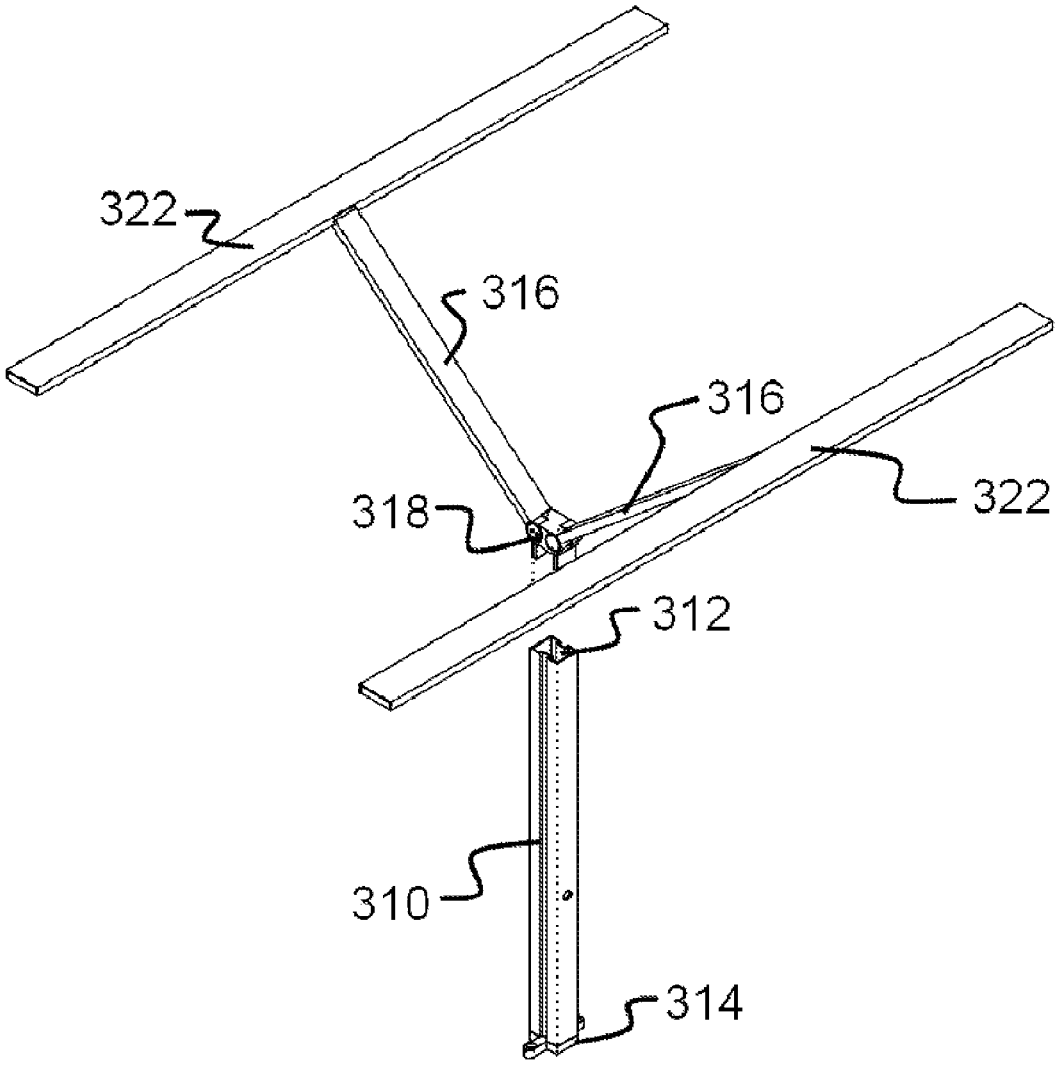
FIG. 3 shows an embodiment for operation with multiple light rails.

FIG. 3 shows an embodiment for operation with multiple light rails. In FIG. 3 an arm 310 includes a hollow center area 312 and an end cap 314 which includes support for mounting the arm 310. Movable arms 316 include a spring-loaded pivot hub 318 which provides for dual operation. The pivot hub 318 includes two tabs 320 formed to fit snugly into the hollow center 312 of the arm 310. Spring tension may be set to accommodate the weight of the movable arms 316 and the light rails 322 attached at the end of the movable arm 316.

Figure 4:
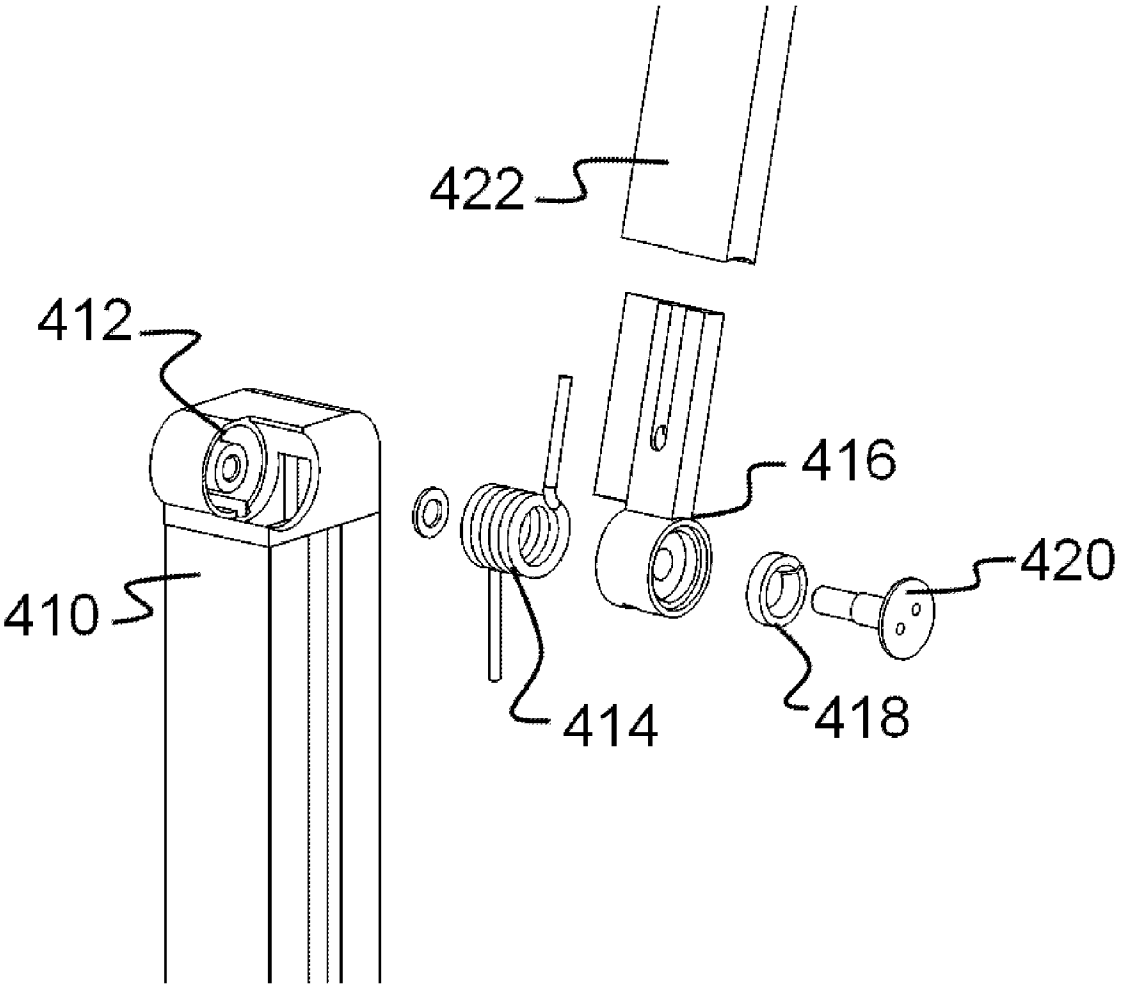
FIG. 4 shows details of one embodiment of a spring-loaded pivot hub.

FIG. 4 shows details of one embodiment of a spring-loaded pivot hub. An arm 410 includes a stator portion of the hub 412. The stator portion of the hub 412 may include one or more extended members or tabs (not shown) which are inserted into a hollow in arm 410. The stator portion of the hub 412 may be substantially circular and includes a threaded receptor for receiving a pin 420. A coiled spring 414 having extended ends is installed with one end positioned into the arm 410 and the other end in a housing 416. The housing 416 has a circular rotor portion and an elongated portion, and the spring end is inserted into the elongated portion of the housing 416. The elongated portion of the housing 416 is also formed to hold a movable arm 422 which slips over the elongated portion. The pin 420 is positioned through the rotor portion of the housing 416 and may be set in place using one or more slip washers or bearings 418. The end of the pin 420 is positioned into the center of the stator portion of the hub 412 and operates to hold the spring-loaded moveable arm 422 together through the pivot action.

When assembled, the coiled portion of the spring 414 is enclosed between the static circular housing and the rotor circular housing. The pin 420 secures the parts together and allows for pivoting about the pin 420. With the pin 420 may be screwed into the stator portion of the hub 412, but still allow for movement because the pin 420 is not threaded the whole length. Also, the o-ring 418 and other o-rings which may be employed may be manufactured from TEFLON or other low friction material to allow for moving the moveable arm 422 about the hub.

The torsion strength of spring 414 may be selected based on the weight of a luminaire which may be attached to the moveable arm 422. This provides for a spring loaded knuckle which may be positioned by the user. Some embodiments may allow pin 420 to be tightened having the affect of locking the moveable arm 422 in place.

The above illustration provides many different embodiments or embodiments for implementing different features of the invention. Specific embodiments of components and processes are described to help clarify the invention. These are, of course, merely embodiments and are not intended to limit the invention from that described in the claims.

Certain aspects and embodiments of the current disclosure are included in the attached appendix which is incorporated by reference as if fully set forth herein.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

We claim:

1. A device including:

a first arm, said first arm including a hollow portion at a first end;

a stator, said stator including a substantially circular stator housing and a tab portion, said tab portion including a plurality of tabs, said plurality of tabs frictionally disposed inside the hollow portion to secure the stator in place, said stator housing including a threaded receptor;

a rotor, said rotor including a substantially circular rotor housing and an elongated portion, said rotor housing slidably coupled to the stator housing, a coiled spring, said spring formed with an elongated first end and an elongated second end, said spring disposed between the stator housing and the rotor housing wherein the first elongated end extends into the hollow portion of the first arm and the second elongated end extends into the elongated portion of the rotor; and, a pin, said pin disposed through the rotor housing and through the stator housing, wherein said pin is partly threaded such that said pin includes a shank portion without threads and a threaded portion, wherein the threaded portion of said pin engages with said threaded receptor of said stator housing such that movement of said threaded portion is substantially restricted with respect to said stator housing, wherein the shank portion of said pin is slidably coupled to said stator housing, wherein the shank portion of said pin allows for substantially unrestricted movement of said rotor housing about said pin.

2. The device of claim 1 further including a second arm disposed on the rotor, wherein the elongated portion is frictionally inserted into a hollow portion on the second arm.

3. The device of claim 2 further including a light rail, said light rail disposed on the second arm, said light rail composed of one or more light sources.

4. The device of claim 3 further including electrical wiring disposed through the stator and rotor housing, and through the second arm.

5. The device of claim 1 further including a light rail, said light rail coupled to the first arm, said light rail composed of one or more light sources.

* * * * *